US005822950A

United States Patent [19]

de Moya et al.

[11] Patent Number: 5,822,950

[45] Date of Patent: Oct. 20, 1998

[54] MAESTRO MOUTHPIECE

[76] Inventors: Jorge de Moya, 195 Walden Way, Wakefield, R.I. 02879; Albert E. Basso, 51 Poppe Rd., Springfield, Vt. 05156

[21] Appl. No.: 628,091

[22] Filed: Apr. 9, 1996

[51] Int. Cl.[6] ..... B68B 1/06

[52] U.S. Cl. ..... 54/8

[58] Field of Search ..... 54/7, 8

[56] References Cited

U.S. PATENT DOCUMENTS

| | | | |
|---|---|---|---|
| 388,268 | 8/1888 | Davis | 54/7 |
| 754,632 | 3/1904 | Anderson | 54/7 |
| 2,512,244 | 6/1950 | De Wolfe | 54/7 X |
| 4,965,987 | 10/1990 | Bork | 54/7 |
| 5,062,255 | 11/1991 | Myler et al. | 54/7 |

OTHER PUBLICATIONS

Benjamin Latchford, *The Loriner*, London: Nichols, Son & Co., 1871, pp. 14–37.

Don Juan Segundo, *A Treatise on the Suitable Bitting of Horses*, London: Nichols, Son & Co., 1832.

*Primary Examiner*—Robert P. Swiatek

*Attorney, Agent, or Firm*—Young & Basile, PC

[57] ABSTRACT

A first mouthpiece having a flat heel surface 12 which rests directly on a horse's bars, a tongue porte 14 of sufficient size to receive a horse's tongue and of such height so as not to interfere with most horse's palates, a horizontal tongue shelf 16 of sufficient length to provide a comfortable resting place for the tongue, a rotation mechanism 32 and a rotation stop 30 embedded in the inside end 48 of a right mouthpiece extension 46 to protect the tongue. Rotatable right and left mouthpiece extensions 46 and 40 are coupled to the cannons 10 to isolate rotation of bridle reins from the cannons.

17 Claims, 5 Drawing Sheets

MAESTRO MOUTHPIECE

BACKGROUND OF THE INVENTION

1. Field of the Invention

This invention relates to horse bits, and specifically, to horse mouthpieces.

2. Description of Prior Art

Throughout the ages, horses have been controlled primarily through the use of instruments placed inside their mouths and attached to a rider's hands by means of reins. These instruments are called bits and the portion which is inserted into the horse's mouth is called a mouthpiece. A mouthpiece has several parts among them the cannon, heel, and porte. The mouthpiece is generally held between the top of the horse's tongue and palate and runs horizontally from lip to lip.

Bits are generally classified into snaffle bits or curb bits. The difference between these is that the snaffle bit has no leverage while curb bits (also called leverage bits) act by the leverage provided by the interaction of a strap around the horse's chin (called a curb chain or curb strap) and levers called shanks.

Mouthpieces of curb bits have historically been cylindrical or slight modifications thereof, the theory being that the larger the diameter of the cylinder, the milder the bit and vice versa. The mouthpieces of curb bits are normally solidly attached to the side pieces (shanks) so that when the reins (which are attached to the shanks) move the shanks, the curb chain tightens and the mouthpiece rotates the horse's mouth and presses the tongue against the sharp bars (portion of the lower jaw devoid of teeth) of the mouth.

An in depth study of the design of bits throughout the ages shows that the biggest problem to overcome has always been this action of the bit on the tongue. In some ages when the horse was used as a weapon of war, it was not uncommon for the mounted warrior to cut the horse's tongue off so that the mouthpiece of the curb bit would rest on the bars without interfering with or inflicting damage to the tongue.

Another solution to the problem of the tongue has been to increase the diameter of the cannon (the portion of the mouthpiece that presses the tongue against the bars). While it is true that a larger, round cannon will be considerably less severe on the horse's tongue and bars than a thinner one, it is nevertheless also true that when no pressure is applied to the mouthpiece the larger, round cannon bears on the tongue or on the bars on a point just as a smaller diameter cannon does. It is only when pressure is applied to the mouthpiece and the mouthpiece begins to dig into the tongue and/or fleshy covering of the bars that the larger round cannon becomes milder than a thinner one.

In order to understand the impact of a curb bit, one must understand the anatomy of a horse's mouth.

The anatomical components of the mouth which are impacted by curb bits are the horse's tongue, the palate, and the bars. The bars in a horse's mouth constitute a space in the bony structure of the jaws between the molars and incisors which is devoid of teeth. The bony structure of the bars is sharp and thin and covered with a small amount of flesh (1/16–1/4 inch).

Because the space between the lower bars of the horse's mouth is insufficient to accommodate the horse's tongue, the tongue naturally overflows onto the bars. When a curb bit is inserted into a horse's mouth it lies on the tongue in its entirety. When a rider pulls on the reins, pressure is applied to the tongue through the leverage action of the shank and curb chain. When this occurs, the tongue is pressed onto the thin, sharp bars causing pain to the horse against which the horse rebels by throwing its head, rearing, star gazing, over tucking or running away in desperation.

When a curb bit has a porte (an elevated portion of the mouthpiece), the palate, and molars of the horse's mouth are also a consideration. Depending on its height and width, a porte can cause interference with the molars and pressure on (and even perforation of) the palate. Depending on the rotational ability of the porte, it could also flip forward in the horse's mouth and hit the incisors.

In the mid-1800's Don Juan Segundo made and wrote about specially designed curb bits with tongue portes (see *The Loriner* published first in 1871). It is not apparent whether these curb bits were ever patented in Europe. These curb bits had several shortcomings.

The mechanism for rotation of the mouthpiece was not specified and without such specification, the functioning of the bit was ineffective at best, harmful to the horse's mouth at worst. It is our belief that this is the primary reason that this bit has all but disappeared from common use.

The mouthpiece surface resting on the horse's bars was round causing pressure points on the horse's bars.

The mouthpiece was too high causing occasional pressure on the palate and sometimes interfering with the horse's ability to close its mouth.

The solution then proposed to solve the problem of the pressure points was a mouthpiece of such a large diameter (up to 7/8 inch) that it raised the whole bit in the horse's mouth exacerbating the interference with the palate and it filled the horse's mouth so it was sometimes difficult to close.

For some horses there was insufficient tongue room within the tongue porte.

The downward slope and narrowness of the tongue shelf made it easier for the horse to accidentally remove the tongue from the porte by pressing it downward.

The design required an entirely different mouthpiece for horses with different size mouths.

SUMMARY OF THE INVENTION

Accordingly, the present invention has several objects and advantages.

One object is to provide a "bar-friendly" cannon through the use of a cannon with flat heels. The cannon of the present mouthpiece, while made from round bar stock, has heels cut flat on the opposite side of the tongue porte so that a flat area is in contact with the bars at all times. The edges of this flat surface are rounded off to provide a smooth transition to the rest of the cannon. This solves two problems with the original design. It eliminates the pressure points and lowers the mouthpiece in the horse's mouth to lessen interference with the palate.

If at any time the horse, by movement of its tongue, has placed the rounded edges of the flat surface in contact with the bars the slightest pressure transmitted from the reins to the mouthpiece will cause it to rotate and turn so that the flat surface is again in contact with the bars. In this manner, it is ensured that when any pull is applied to the reins, the heels (the flat and mildest spot of the cannon) will be resting on the bars.

The heels, while flat and perpendicular to the axis of the mouthpiece, are cut on a curve along the mouthpiece in such a way that two benefits accrue: first, the widest (thus mildest) spot on the flat cut will be approximately over the horse's bars (normally about one inch apart); second, the cut radius decreases from the outside to the inside of the heels thus providing the horse's tongue with an easy entrance funnel to the tongue porte without the horse having to retract its tongue in order to insert it into the tongue porte. In other words, the horse is able to insert its tongue into the tongue porte by sliding it upward into the tongue porte through the funnel-like gap between the heels.

The flat cut on the cannons also eliminates the need to utilize extremely large diameter mouthpieces to ensure the mildest contact on the horse's bars.

Another object is to provide comfort in any head position by means of an effective mechanism for rotation. An effective mechanism for rotation has been developed which is a function of the way the cannon is attached to the mouthpiece extensions. This results in a tongue porte which provides the horse with a safe and unthreatening space for its tongue because it stays stationary in the horse's mouth at all positions of the horse's head from horizontal to vertical. Within this range of head positions, the present mouthpiece stays stationary being independent of the normal movement of the side pieces (shanks).

Another object is to provide comfort independent of shank action by means of an effective rotation mechanism. Further, in order for the tongue to be permanently protected, the tongue porte, heels and cannon must not move when the rider is picking up the rein(s) and applying leverage through the shank(s). The rotation mechanism of the present mouthpiece is such that the normal movement of the shank(s) is independent of the mouthpiece (tongue porte, heels, and cannon). The benefit to the horse is this: when the rein(s) commanded by the rider's hand(s) to make the side piece(s) rotate to engage the curb chain, the mouthpiece inside the horse's mouth stays stationary preventing a threat to the horse's tongue. In other words, once the horse has comfortably inserted its tongue into the tongue porte, the tongue is safe from any normal movement of the shanks caused by a rider's pull on the rein(s).

The rotation mechanism also has a built in stop pin which prevents the tongue porte from rotating forward and interfering with the horse's incisors. This also helps the rider to properly insert the bit into the horse's mouth.

Another object is to provide a tongue porte with sufficient space for the tongue. The first consideration has been to provide sufficient space by means of an arch which we will call the tongue porte, into which the horse can insert its tongue. To do this, the design of the tongue porte is such that the inside of the arch is flat, rather than round; the height of the tongue porte is low enough and the tongue porte wide enough to provide sufficient area for the tongue while preventing interference with the horse's palate or molars.

Another object is to provide a tongue shelf which is an effective resting place for the tongue. The design of the present mouthpiece tongue shelf is both horizontal and long enough to provide a resting place for the tongue and to make it difficult for the horse to accidentally slip its tongue down through the opening.

Finally, another object is to fit different sizes of mouths through the use of interchangeable mouthpiece extensions. The mouthpiece extensions (with embedded rotation mechanism) come in various lengths and attach to the mouthpiece making it possible to fit any width of a horse's mouth. This eliminates the need to buy entirely separate bits for horses with different size mouths ranging from 4.5 to 5.5 inches.

All of these design attributes contribute to the willingness of the horse to travel in a natural collected manner and eliminate such common defenses against the harsh actions of other bits as stargazing, over tucking, head tossing, leaning on the bit or running away in desperation. They also contribute to the convenience of having one bit which fits a wide range of mouth sizes.

DESCRIPTION OF THE DRAWINGS

The various features, advantages and other uses of the present invention will become more apparent by referring to the following detailed description and drawing.

DETAILED DESCRIPTION OF THE INVENTION

Figure 1B:
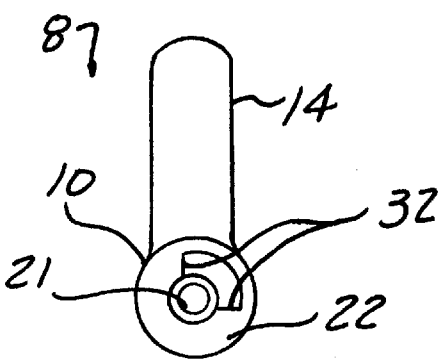
FIG. 1B is a right hand end view of the mouthpiece shown in FIG. 1A.

The present invention is a mouthpiece 8 having five parts: cannon 10, heels 12, tongue porte 14, tongue shelf 16 and the mouthpiece extensions 46 and 40 with embedded rotation mechanism 32.

Figure 1D:
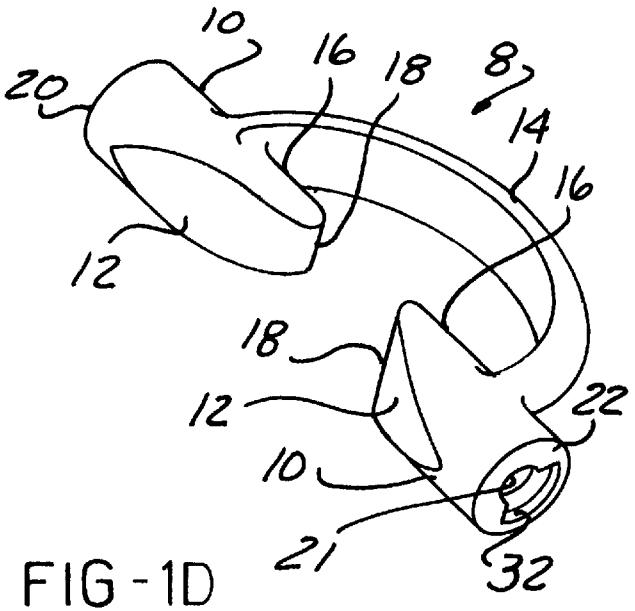
FIG. 1D is a perspective view of the mouthpiece shown in FIGS. 1A–1C.
Figure 1A:
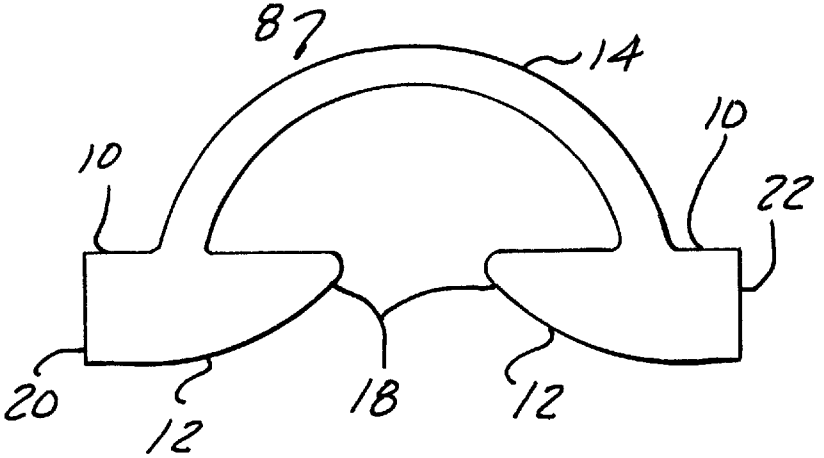
FIG. 1A is a front elevevational view of a mouthpiece constructed in accordance with the teachings of the present invention, without extensions.
Figure 1C:
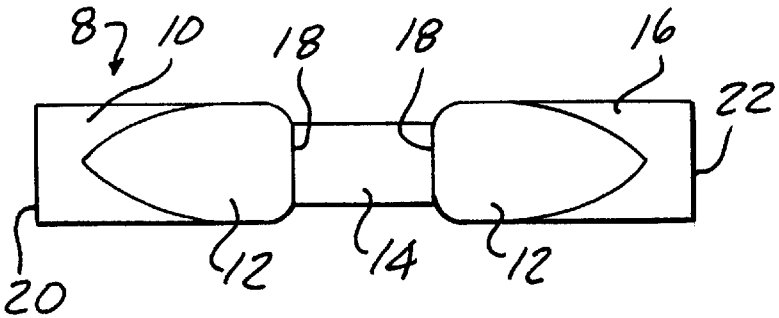
FIG. 1C is a bottom elevational view of the mouthpiece shown in FIG. 1A.

A typical embodiment of the mouthpiece of the present invention is illustrated in FIG. 1A and FIG. 1D.

The mouthpiece 8 is preferably formed of a one piece, integral member including the cannons 10, heels 12, tongue porte 14 and tongue shelf 16. However, the cannons 10, heels 12, tongue porte 14 and tongue shelf 16 may be individually formed, and then joined to each other in the following described arrangement by means of suitable means.

As shown in FIGS. 1A–1D, the mouthpiece 8 includes a pair of cannons 10 which are formed of generally circular cross-section stock. A radius flat cut is formed on a bottom surface of each cannon 10 extending from a point inward of an outer end 20 of the cannon 10 to an inner end 18 to form a flat heel 12 having an end 18 at an inner portion of each cannon 10. The inner end 18 of each heel 12 is formed in a smooth radius which extends into and forms the tongue shelf 16.

The tongue shelf 16 has a smoothly curved outer surface consistent with the outer diameter cannons 10. The tongue porte 14 is formed of half round or semi-circular stock which is bent into an arcuate shape. Opposite ends of the tongue porte 14 are integrally joined to an intermediate portion of each cannon 10 between the outside end 20 and the inside end 18 of each cannon 10. The heel ends 18 are generally equal distance from a center of the tongue porte 14.

A counter bore 21 extends inward from the outer end 20 and 22 of each cannon 10. The bore 21 includes an tapped inner end for receiving a threaded shoulder bolt 52.

The outside end surface of the right outer end 22 of the right hand cannon 10 includes a rotation stop 32 as shown in FIGS. 1B and 1D. The rotation stop 32 is in the form of a recess in the outer end 22 of the right hand cannon 10 and extends over an approximate 90° arc. The rotation stop 32 is engaged by a pin 30 on one mouthpiece extension 46, as described hereafter.

Figure 2B:
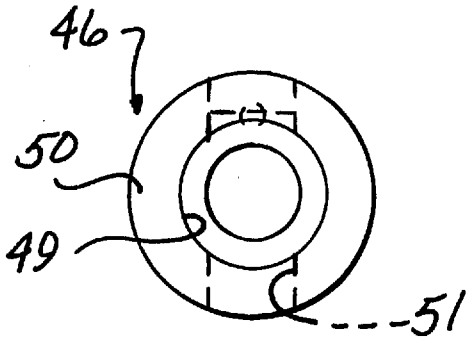
FIG. 2B is a right hand end view of the right mouthpiece extension shown in FIG. 2A.
Figure 3B:
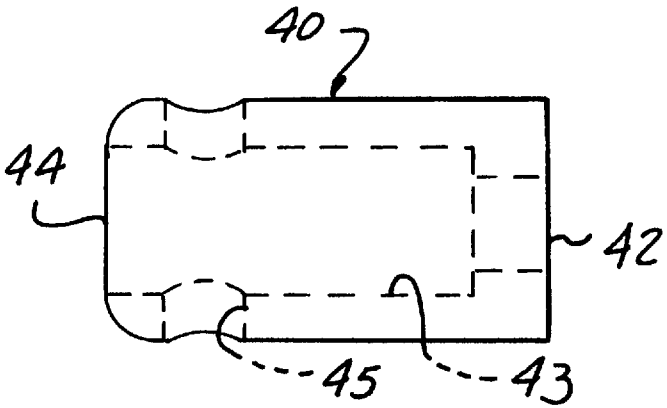
FIG. 3B is a side elevational view of the left mouthpiece extension shown in FIG. 3A.
Figure 2A:
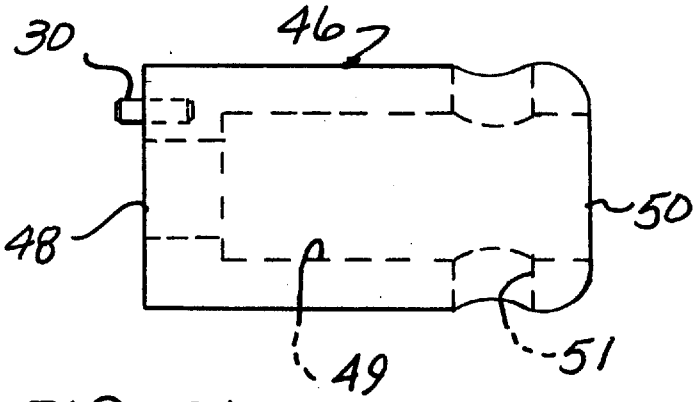
FIG. 2A is side elevational view of a right mouthpiece extension useable with the mouthpiece shown in FIG. 1A.
Figure 3A:
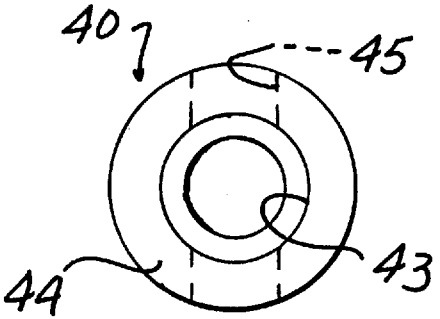
FIG. 3A is a left hand end view of a left mouthpiece extension useable with the mouthpiece shown in FIG. 1A.
Figures 4A, 4B, 4C, 4D:
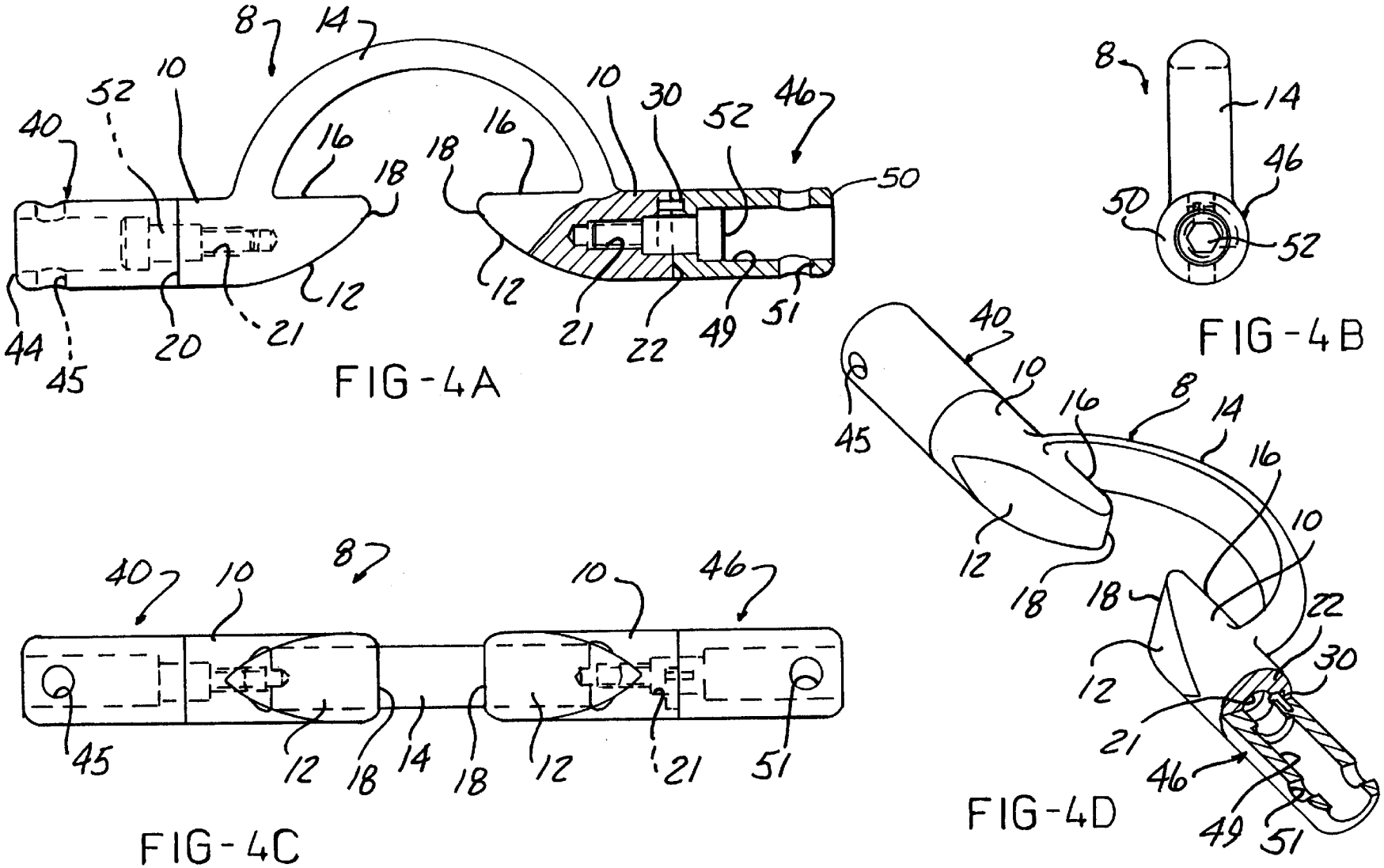
FIG. 4A is a partially cross-sectioned, front elevational view of the mouthpiece of FIG. 1A with the left and right mouthpiece extensions mounted thereon.
FIG. 4B is a right hand end view of the mouthpiece and mouthpiece extensions shown in FIG. 4A.
FIG. 4C is a bottom elevational view of the mouthpiece and mouthpiece extensions shown in FIG. 4A.
FIG. 4D is a perspective view of the mouthpiece and mouthpiece extensions shown in FIGS. 4A–4C.
Figure 5:
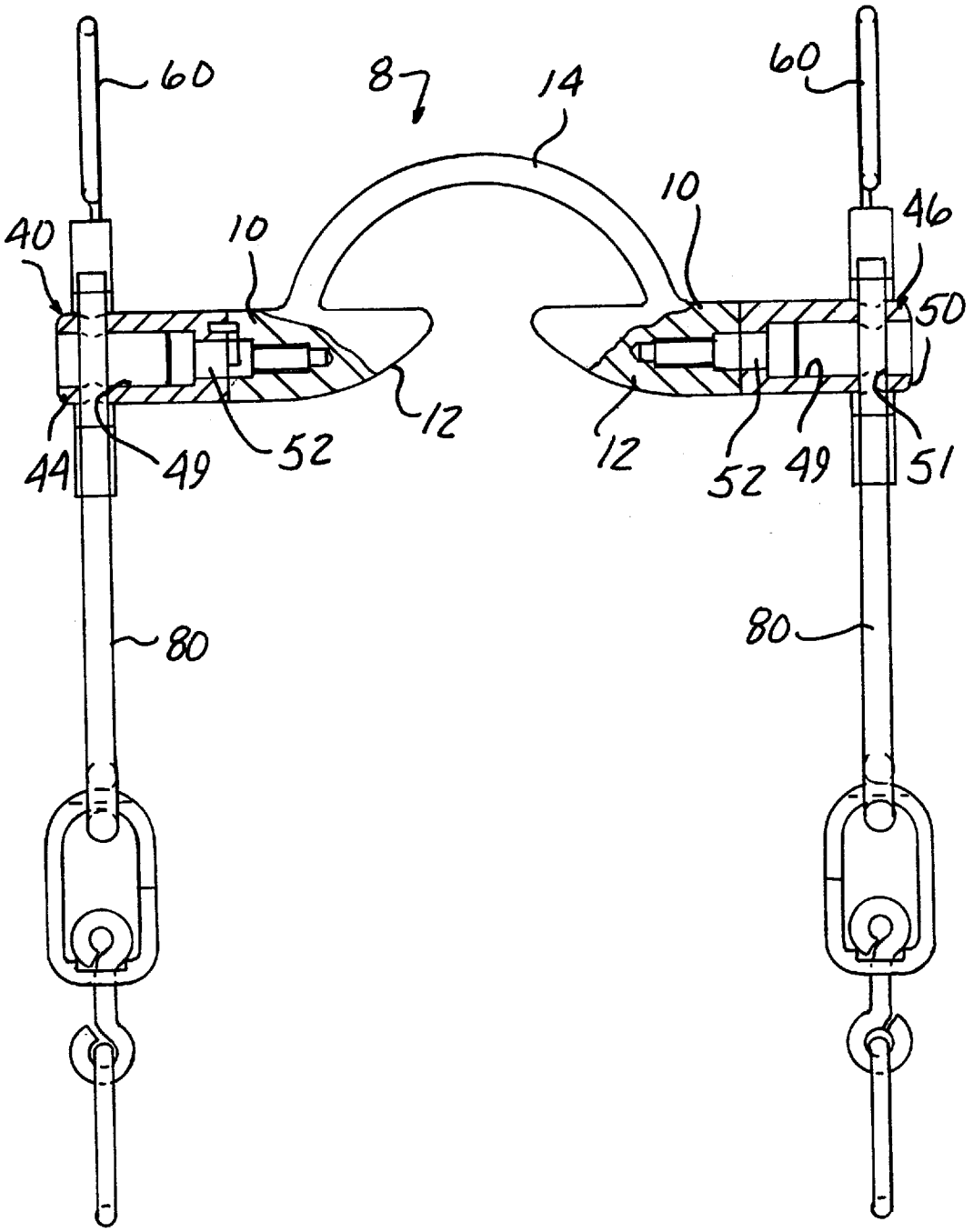
FIG. 5 is a front elevational view with the mouthpiece and mouthpiece extensions shown in FIG. 4A coupled to shanks and bridle reins.

A pair of mouthpiece extensions including a right mouthpiece extension 46 shown in FIGS. 2A and 2B and a left mouthpiece extension 40 shown in FIGS. 3A and 3B are attached to the outer ends 22 and 20, respectively, of the cannons 10. The right mouthpiece extension 46, shown in FIGS. 2A and 2B is formed of round stock and can be provided in varying lengths between opposed ends 48 and 50. The following table shows examples of approximate sizes or lengths of the right hand extension for various overall bit sizes so as to enable the present mouthpiece 8 to be used with different size horse mouths.

| Bit Size | Extension Length |
|---|---|
| 4½" | 22.86 MM/(.900) |
| 4¾" | 26.035 MM/(1.025) |
| 5" | 29.21 MM/(1.150) |
| 5¼" | 32.385 MM/(1.275) |
| 5½" | 35.56 MM/(1.400) |

The dimensions shown in the above table are useable in a large percentage of the equine population. However, it is clear that other dimensions for the mouthpiece extensions may also be employed to suit a particular forces.

The same size range is applied to the left mouthpiece extension 40.

A longitudinally extending counter bore 49 extends through the right hand mouthpiece 46 between the opposed ends 48 and 50. A smaller diameter cross-bore 51 extends through the right mouthpiece extension 46 at a position spaced a short distance from the end 50 and intersects the longitudinal bore 49 as shown in FIGS. 2A and 2B.

A rotation stop pin 30 is mounted in the end 48 of the right mouthpiece extension 46 and extends outward therefrom for engagement in the rotation stop 32 formed in the outer end 22 of the right cannon 10 of the mouthpiece 8. In this manner, while the right mouthpiece extension 46 is free to rotate about the shoulder bolt 50 with respect to the right cannon 10, the rotation stop pin 30 limits the amount of such rotation to approximately 90°.

The left mouthpiece extension 40, as shown in FIGS. 3A and 3B, is similarly formed of round stock in varying lengths, as shown in the above table, for use in different sizes of horse's mouths. A longitudinal counter bore 43 extends longitudinally between opposed ends 42 and 44 of the left mouthpiece extension 40. A transverse bore 45 extends laterally through the left mouthpiece extension 40 at a position spaced from the end 44 and intersects the longitudinal bore 43 as shown in FIGS. 3A and 3B.

If the horse owner has several horses with mouths of different widths (4.5 inches to 5.5 inches), the horse owner can disassemble the bit, choose mouthpiece extensions 40, 46 of the correct size, and reassemble the bit in the size appropriate to the horse's mouth.

The manner of using the mouthpiece 8 is identical to that for using other curb bits. The mouthpiece 8 is attached to shanks 80 and hung onto the horse's bridle by means of the bridle rings 60 of the shank 80. The heels 12 of the mouthpiece lie across the bars of the horse's mouth.

When the mouthpiece 8 is hung in the horse's mouth, the horse will slip its tongue into the tongue porte 14 and rest it on the tongue shelf 16. The horse will find a comfortable position for the mouthpiece 8 such that the flat heels 12 are resting directly on the horse's bars. The rotation mechanism 30, 32 embedded in the mouthpiece extensions 40, 46 enables the horse to maintain the mouthpiece 8 in this comfortable position. The rotation stop pin 30 embedded in the right mouthpiece extension 46 also ensures that the mouthpiece 8 cannot turn upside down or lie backwards in the horse's mouth.

The heels 12 are of such length and distance apart that the widest portion of the flat surface will rest directly on the bars of the horse's mouth and no pointed surface can cause the horse discomfort.

From the above description, a number of advantages of the present mouthpiece become apparent.

The present mouthpiece 8 provides the heels 12 with a comfortable flat surface to rest directly against the bars of the horse's mouth. The edges of the heels 12 are rounded off to provide a smooth transition to the rest of the cannon 10. This solves multiple problems with prior art bits. It eliminates the pressure points and eliminates the need for a large diameter (milder) cannon. If at any time the horse, by movement of its tongue, has placed the rounded edges of the heels 12 in contact with the bars, the slightest pressure transmitted from the rein(s) to the mouthpiece 8 will cause it to rotate and turn so that the flat heels 12 are again in contact with the bars. In this manner, it is ensured that when any pull is applied to the reins, the flat and mildest spot of the heels 12 will always be resting on the bars. The flat cut of the heels 12 also eliminates the need to utilize extremely large diameter mouth pieces to ensure the mildest contact on the horse's bars.

Figure 6:
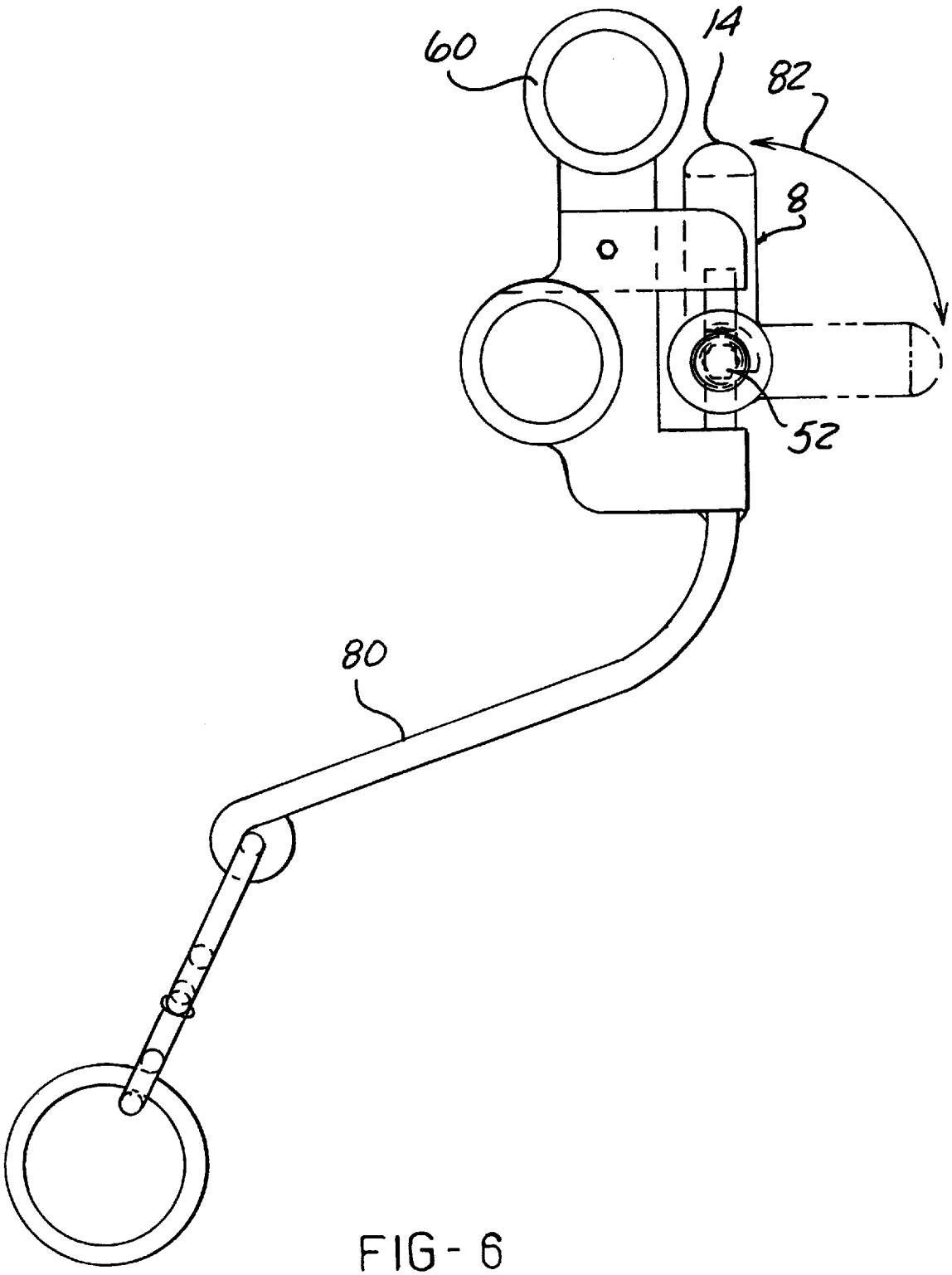
FIG. 6 is a side elevational view of FIG. 5.

The present invention provides the horse with comfort in any head position from vertical to horizontal by means of an effective mechanism for rotation. Within this range of head positions as shown by reference number 82 in FIG. 6, the mouthpiece 8 stays stationary behind independent of the normal movement of the side pieces. This also ensures that the tongue porte 14 provides the horse a safe and unthreatening space for its tongue because it stays stationary in the horse's mouth.

Further, the tongue is permanently protected, because the tongue porte 14, heels 12 and cannons 10 do not move when the rider is picking up the rein(s) and applying leverage through the shank(s). The rotation mechanism 30, 32 of the mouthpiece 8 is such that the normal movement of the shank(s) 80 is independent of the mouthpiece 8 (tongue porte 14, heels 12 and cannons 10). The benefit to the horse is this: when the rein(s) commanded by the rider's hands make the shank(s) 80 rotate to engage the curb chain, the mouthpiece 8 inside the horse's mouth stays stationary preventing a threat to the horse's tongue. In other words, once the horse has comfortably inserted its tongue into the tongue porte 14, the tongue is safe from any normal movement of the shank(s) 80 caused by a rider's pull on the rein(s).

The heel 12 is cut on a curve thus ensuring two things: first, the widest (and mildest) spot on the flat cut will be approximately over the horse's bars (normally about one inch apart); second, the cut radius decreases from the outside to the inside of the heel 12 providing the horse's tongue with an easy funnel-like entrance to the tongue porte 14 without having to retract its tongue in order to insert it into the tongue porte 14. In other words, the horse is able to insert its tongue into the tongue porte 14 by sliding it upward into the tongue porte 14 through the gap between the spaced inner ends 18 of the heels 12.

The tongue porte 14 provides sufficient space for the tongue without causing interference to the palate, molars, or incisors. The inside of the arch is flat, rather than round; the height of the tongue porte 14 is sufficiently low and the tongue porte 14 sufficiently wide to provide more area for the tongue without causing either interference with or damage to the horse's palate, molars or incisors.

The tongue shelf 16 is an effective resting place for the tongue. The design of the tongue shelf 16 is both horizontal and longer than prior mouthpieces and provides a larger resting place for the tongue making it difficult for the horse to accidentally slip its tongue down through the opening.

One mouthpiece 8 with various size mouthpiece extensions 40, 46 can fit the most common range of horse's mouths (from 4.5 to 5.5 inches). This eliminates the need to buy entirely separate bits for horses with difference size mouths.

Accordingly, the present mouthpiece is the first to truly protect the tongue of the horse and the bars of the horse's mouth. The present mouthpiece:

uniquely provides a flat surface to rest directly against the horse's bars. This flat surface is fairly wide and therefore very comfortable for the horse;

provides a comfortable resting place for the horse's tongue without any danger of the tongue being pressed against the sharp bars no matter what the horse's head position (from vertical to horizontal);

ensures that the tongue porte provides the horse with a safe and unthreatening space for its tongue because it stays stationary in the horse's mouth;

protects the tongue from being pressed against the bars through the leverage action of the rider's reins;

enables the use of a smaller diameter mouthpiece which will not interfere with the closing of the horse's mouth;

provides an easy entrance to the tongue porte without the horse having to retract its tongue in order to insert it into the tongue porte;

provides sufficient space for the tongue without causing interference to the palate, molars or incisors;

provides an effective resting place for the tongue; and eliminates the need to buy entirely separate bits for horses with difference size mouths.

Although the following description contains many specificities, these should not be construed as limiting the scope of the invention; but as merely providing illustrations of some of the presently preferred embodiments of this invention. For example, although the use of the mouthpiece is described in curb bits, it could also be used in snaffle bits. The mouthpiece and mouthpiece extensions can also be made of different materials, such as cold rolled steel, copper, German silver, high strength plastics or aluminum. The sizes discussed herein will serve a majority of the equine population, however the bit should not be limited to the particular specificities shown. Additionally, changes in size of cannons, width of the space between the inside cannon ends, height of the tongue porte, etc. would be subject to modification depending on varying sizes of horse's mouths. The importance of rotation cannot be overemphasized. However, the rotation mechanism can be of a different design with the rotation stop achieved by a different method or the rotation stop being on the other side of the mouthpiece.

We claim:

1. A mouthpiece insertable into a horse's mouth in engagement with a horse's mouth bars and receiving the horse's tongue, the mouthpiece comprising:

a bit having an opposed pair of cannons; a heel projecting inwardly along each cannon from an outer edge of each cannon to an inner end spaced from an inner end of the heel on the opposed cannon, each heel having a flattened portion engageable with a horse's mouth bars.

2. The mouthpiece of claim 1 wherein:

the flattened portion of each heel extends arcuately with respect to a longitudinal axis of each cannon to the inner end.

3. The mouthpiece of claim 2 further comprising:

the inner ends of each heel are spaced apart defining an opening therebetween;

a tongue porte joined to and extending from the pair of cannons, an inner surface of the tongue porte facing the cannons being substantially planar; and a tongue shelf formed on a surface of each cannon opposite from the heel and extending between one end of the tongue porte and the inner end of each heel.

4. The mouthpiece of claim 3 wherein the tongue shelves are spaced apart at the inner ends of the heels.

5. The mouthpiece of claim 3 further comprising:

an extension rotatably attached to each of the pair of cannons, each extension connectable to a rotatable member and isolating rotation of the rotatable member from the cannons.

6. The mouthpiece of claim 5 further comprising:

rotation stop means, cooperatively formed on one of the pair of cannons and one of the mouthpiece extensions, for limiting the amount of rotation of the one extension relative to the one cannon.

7. The mouthpiece of claim 1 wherein the inner ends of each heel define an opening therebetween.

8. The mouthpiece of claim 1 further comprising:

a tongue porte extending from and joined to the pair of cannons, an inner surface of the tongue porte facing the cannons being substantially planar.

9. The mouthpiece of claim 8 further comprising:

a tongue shelf formed on a surface of each cannon opposite from the heel and extending between one end of the tongue porte and the inner end of each heel.

10. The mouthpiece of claim 9 wherein the tongue shelves are spaced apart at the inner ends of the heels.

11. The mouthpiece of claim 1 further comprising:

an extension rotatably attached to each of the pair of cannons, each extension connectible to a rotatable member and isolating rotation of the rotatable member from the cannons.

12. The mouthpiece of claim 11 further comprising:

rotation stop means, cooperatively formed on one of the pair of cannons and one of the extensions, for limiting the amount of rotation of the one extension relative to the one cannon.

13. A mouthpiece insertable into a horse's mouth in engagement with a horse's mouth bars and receiving the horse's tongue, the mouthpiece comprising:

a bit having an opposed pair of cannons; a heel projecting inward along a bottom edge of each cannon to an inner end; and a tongue porte joined to and projecting from each cannon, the tongue porte having an arcuate shape extending between the pair of cannons, the tongue porte having a flat inner surface facing the pair of cannons.

14. The mouthpiece of claim 13 further comprising:

a tongue shelf formed on a surface of each cannon opposite from the heel and extending between one end of the tongue porte and the inner end of each heel.

15. The mouthpiece of claim 14 further comprising:

the tongue shelves formed on the pair of cannons are spaced apart at the inner ends of the heels.

16. A mouthpiece insertable into a horse's mouth in engagement with a horse's mouth bars and receiving the horse's tongue, the mouthpiece comprising:

a bit having an opposed pair of cannons;

a heel projecting inwardly along each cannon from an outer edge of each cannon to an inner end, each heel having a flattened portion engageable with a horse's mouth bars; and a tongue shelf formed on a surface of each cannon opposite from the heel and extending between one end of the tongue porte and the inner end of each heel.

17. The mouthpiece of claim 16 further comprising:

the tongue shelves formed on the pair of cannons are spaced apart at the inner ends of the heels.

* * * * *